United States Patent [19]

Johnston

[11] 4,206,692

[45] Jun. 10, 1980

[54] VENT PIPE COVER

[76] Inventor: Earl D. Johnston, 1226 Ridgeview, Tyler, Tex. 75701

[21] Appl. No.: 24,244

[22] Filed: Mar. 27, 1979

[51] Int. Cl.[2] ..... F23L 17/02

[52] U.S. Cl. ..... 98/122; 52/199; 126/318; 220/367

[58] Field of Search ..... 98/122, 42 R, 66 R, 98/83, 84; 220/367; 52/199, 200; 126/318, 312

[56] References Cited

U.S. PATENT DOCUMENTS

| | | | |
|---|---|---|---|
| 2,524,242 | 10/1950 | Weaver | 98/122 |
| 2,822,744 | 2/1958 | Epstein | 98/84 |
| 2,857,837 | 10/1958 | Carr | 98/84 |

*Primary Examiner*—Ronald C. Capossela
*Attorney, Agent, or Firm*—Lawrence L. Colbert

[57] ABSTRACT

A cover for vent pipes rising from building roofs is formed from a unitary initially flat blank which can be bent to fit around the vent pipe snugly and securely with locking tabs provided to hold the cover in place and stabilize it on the vent pipe. Debris is excluded from the open vent pipe without interference with its ventilating action.

6 Claims, 6 Drawing Figures

FIG.1
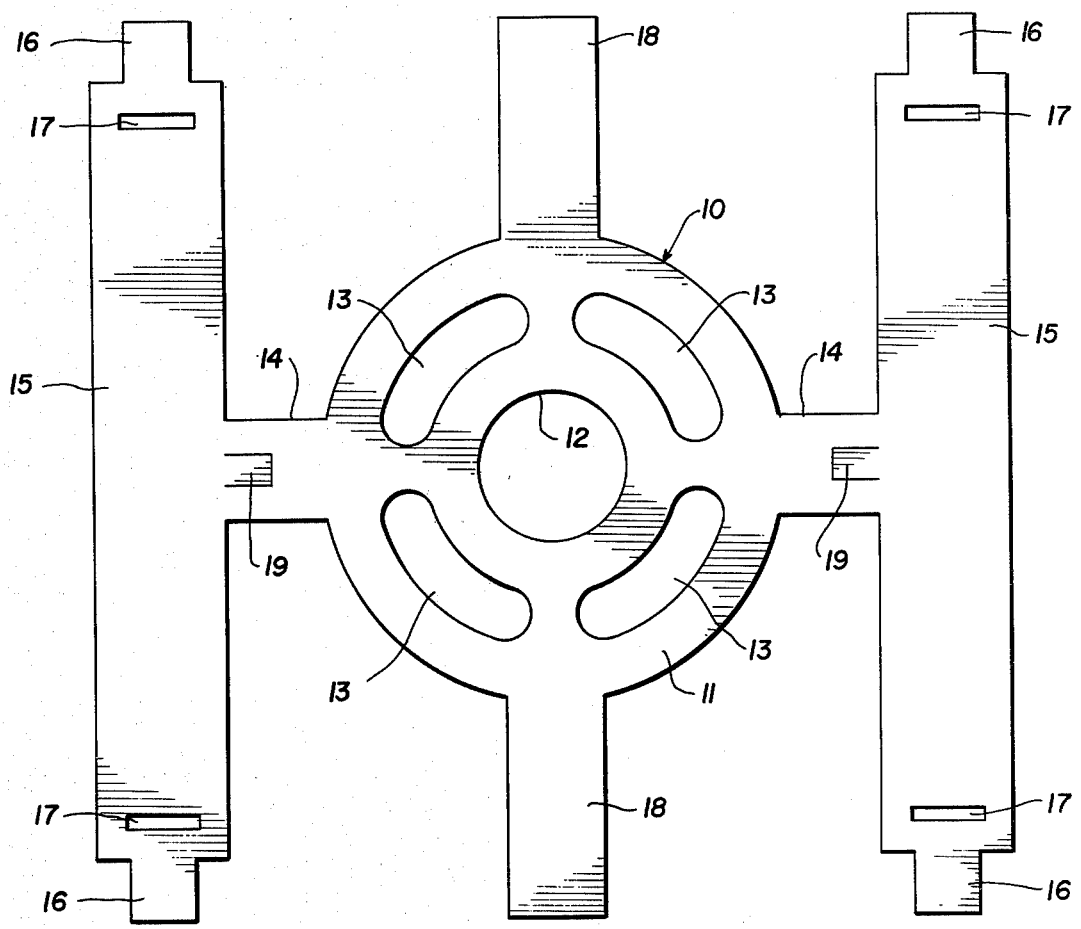
FIG.5
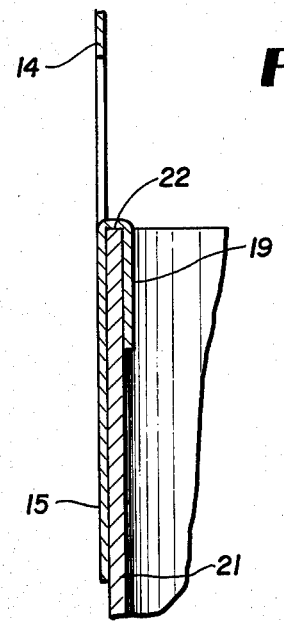
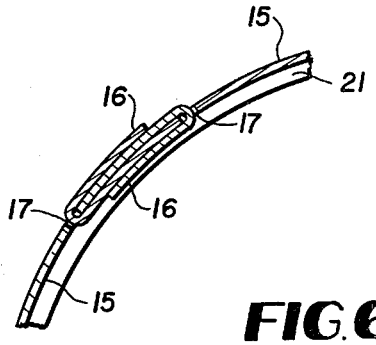
FIG.6

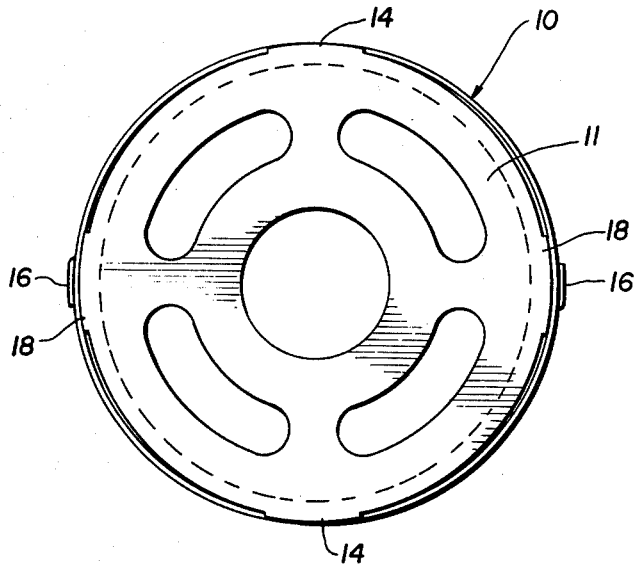
FIG.2
FIG.3
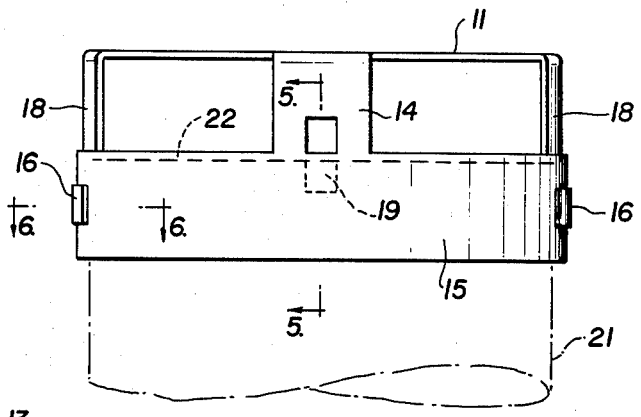
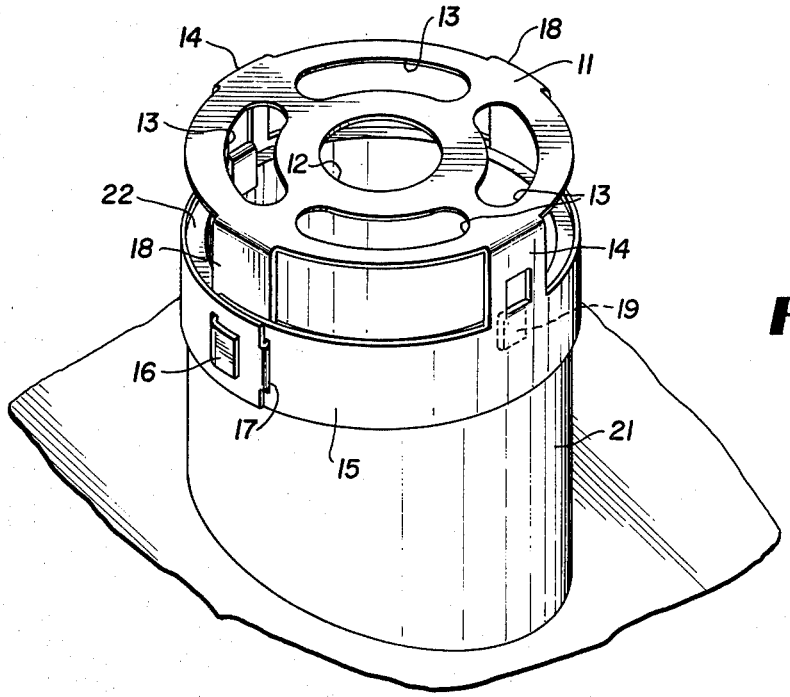
FIG.4

VENT PIPE COVER

BACKGROUND OF THE INVENTION

The present invention seeks to provide a less costly and more convenient and secure cover for the vent pipes of buildings than anything heretofore proposed in the prior art. The cover is provided in the form of an initially flat one-piece metal blank which is stamped out to provide the necessary ventilating openings in the cover and bendable elements which can surround the exterior of the vent pipe and be clamped in snug engagement therewith by locking tabs and slots formed on the blank.

Various features and advantages of the invention will become apparent during the course of the following detailed description.

BRIEF DESCRIPTION OF THE DRAWINGS

FIG. 1 is a plan view of a blank used in the construction of a vent pipe cover according to the invention.

FIG. 2 is a plan view of the cover installed on a vent pipe.

FIG. 3 is a side elevation of the same.

FIG. 4 is a perspective view of the invention.

FIG. 5 is an enlarged fragmentary vertical section taken on line 5—5 of FIG. 3.

FIG. 6 is a fragmentary horizontal section taken on line 6—6 of FIG. 3.

DETAILED DESCRIPTION

Referring to the drawings in detail wherein like numerals designate like parts, the numeral 10, FIG. 1, designates a flat sheet metal blank having a center circular portion 11 provided with a central vent opening 12 and intermediate circumferentially extending vent slots 13, preferably four in number and equidistantly spaced.

Diametrically opposed arms 14 integral with the circular portion 11 extend radially therefrom and are integrally secured to a pair of equal length parallel equal width straps 15 having reduced width end locking tabs 16 and adjacent slots 17 sized to receive the locking tabs. Spaced 90 degrees from the arms 14 is a second pair of diametrically opposed arms or strips 18 integral with the circular portion 11 and having their free ends in lateral alignment with the ends of tabs 16. Additional side tabs 19 are struck from the radial arms 14 with their bases aligned with the parallel edges 20 of straps 15. The blank 10 is thin enough to be readily bendable so that it may be shaped to fit around a vent pipe such as the cylindrical vent pipe 21 shown in FIGS. 3 and 4.

In attaching the cover formed from the blank 10 to the open top of the cylindrical vent pipe 21, the flat blank is initially placed on top of the vent pipe 21 with the circular portion 11 centered to cover the open top of the vent pipe. The invention will be sized to meet the needs of several different standard sizes of pipes.

The two arms 18 are now bent downwardly 90 degrees from the circular portion 11 and lie against the outer surface of the vent pipe 21. The two arms 14 are now similarly bent downwardly at right angles to the circular portion 11 to lie against the outer surface of the vent pipe. The two tabs 19 can now be forced inwardly and bent downwardly over the top edge 22 of the vent pipe, FIG. 5, and serve to stabilize the cover in the vertical direction.

Following all of this, the two half-circle straps are formed around the vent pipe to produce a belt which completely encircles the pipe immediately below its top edge 22. The previously-bent arm 22 will lie inside of the belt formed by the two straps 15, as illustrated.

The locking tabs 16 of the two straps 15 are now engaged through the adjacent slots 17 of the opposing strap and are reversely bent in locking engagement, FIG. 6, with one bent tab lying outwardly of the belt and the other tab lying inwardly. This firmly secures the one piece cover to the vent pipe. The openings 12 and 13 provide adequate ventilation through the cover and the solid portion 11 blocks the entry of debris into the vent pipe. The device is simple and very inexpensive to manufacture, convenient to install, and secure after installation. It requires no cutting or welding operations, screws or other separable fasteners. The advantages of the invention should be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A unitary flat blank formed of bendable sheet material for use in constructing a vent pipe cover, said blank comprising a central substantially circular portion having vent openings formed therethrough and adapted for registration with the top of a vent pipe, a first pair of diametrically opposed bendable arms radiating from said center circular portion of the blank and adapted to be bent at right angles to the center circular portion to lie along the outer surface of a vent pipe, a second pair of bendable arms which are diametrically opposed and spaced substantially 90 degrees from the first pair of arms and adapted to be bent 90 degrees to said circular portion to lie along the outer surface of a vent pipe, a pair of parallel substantially equal length strap elements carried by the outer ends of the arms in said second pair and extending equidistantly beyond opposite sides of such arms and being parallel to the arms of the first pair, locking tabs on the opposite ends of said strap elements, and the strap elements having locking slots near their opposite ends for the reception of the locking tabs of the opposing strap elements, the strap elements being bendable into surrounding relationship with a vent pipe to completely encircle it and the locking tabs after insertion through said locking slots being bendable into interlocking relationship with the slots, said first pair of arms being then disposed interiorly of said straps which are encircling a vent pipe.

2. A unitary flat blank as defined in claim 1, and the overall length of each strap element inclusive of said locking tabs being substantially equal to the overall length of the blank along the axis of the first pair of bendable arms prior to the bending thereof.

3. A unitary flat blank as defined in claim 1, and a pair of side tabs struck from the arms of said second pair and adapted after the bending of the last-named arms to be forced inwardly and bent over the top edge of a vent pipe to locate and stabilize the blank relative to such top edge.

4. A vent pipe cover comprising a substantially flat circular end plate having vent openings formed therethrough and adapted to overlie the open end of a vent pipe, a first pair of arms bent downwardly from the margin of said end plate and lying along the outer surface of the vent pipe, a second pair of arms spaced substantially 90 degrees from the first pair and bent downwardly from the margin of said end plate and lying along the outer surface of the vent pipe, a pair of vent pipe encircling straps secured to the lower ends of the arms in said second pair and extending on opposite sides of such arms substantially at right angles thereto, each strap having opposite end bendable locking tabs and locking tab slots near and inwardly of the locking tabs, whereby the two straps may completely encircle the periphery of the vent pipe and be securely locked around it snugly.

5. A vent pipe cover as defined in claim 4, and said first pair of arms engaging inside of said straps and being held in their downwardly bent positions by the straps after the straps are locked around the vent pipe.

6. A vent pipe cover as defined in claim 4, and a pair of side tabs on said second pair of arms immediately above said straps and adapted to be bent inwardly and over the top edge of the vent pipe and then downwardly over the interior surface of the vent pipe, said side tabs stabilizing the cover in the vertical direction.

* * * * *